US009472332B2

(12) United States Patent
Nakamura et al.

(10) Patent No.: US 9,472,332 B2
(45) Date of Patent: Oct. 18, 2016

(54) COIL SUBSTRATE, METHOD OF MANUFACTURING THE SAME, AND INDUCTOR

(71) Applicant: SHINKO ELECTRIC INDUSTRIES CO., LTD., Nagano-shi, Nagano (JP)

(72) Inventors: Atsushi Nakamura, Nagano (JP); Kiyokazu Sato, Nagano (JP)

(73) Assignee: SHINKO ELECTRIC INDUSTRIES CO., LTD., Nagano-shi, Nagano (JP)

( * ) Notice: Subject to any disclaimer, the term of this patent is extended or adjusted under 35 U.S.C. 154(b) by 39 days.

(21) Appl. No.: 14/341,868

(22) Filed: Jul. 28, 2014

(65) Prior Publication Data

US 2015/0035639 A1 Feb. 5, 2015

(30) Foreign Application Priority Data

Jul. 31, 2013 (JP) ..... 2013-159572

(51) Int. Cl.
*H01F 5/00* (2006.01)
*H01F 17/00* (2006.01)

(52) U.S. Cl.
CPC ..... *H01F 17/0033* (2013.01); *H01F 5/00* (2013.01); *H01F 17/0013* (2013.01); *Y10T 29/4902* (2015.01)

(58) Field of Classification Search
CPC ..... H01F 5/00; H01F 27/00–27/30
USPC ..... 336/65, 83, 200, 206–208, 232
See application file for complete search history.

(56) References Cited

U.S. PATENT DOCUMENTS

| | | | | |
|---|---|---|---|---|
| 8,633,794 | B2 * | 1/2014 | Ito | H01F 17/0013 336/200 |
| 2008/0012679 | A1 * | 1/2008 | Okabe | H01F 10/20 336/200 |
| 2010/0033286 | A1 * | 2/2010 | Katayama | H01F 17/0013 336/200 |
| 2010/0085140 | A1 * | 4/2010 | Tanaka | C04B 35/265 336/221 |

FOREIGN PATENT DOCUMENTS

JP 2003-168610 A 6/2003

* cited by examiner

*Primary Examiner* — Tuyen Nguyen
(74) *Attorney, Agent, or Firm* — Drinker Biddle & Reath LLP

(57) ABSTRACT

A coil substrate includes a plurality of structural bodies, each of which comprises a first insulating layer, a wiring formed on the first insulating layer and configured to serve as a part of a spiral coil, and a second insulating layer formed on the first insulating layer and configured to cover the wiring. The plurality of structural bodies are stacked via an adhesion layer. The spiral coil is formed by series-connecting the wirings of adjacent ones of the plurality of structural bodies.

9 Claims, 13 Drawing Sheets

FGI. 7B

COIL SUBSTRATE, METHOD OF MANUFACTURING THE SAME, AND INDUCTOR

CROSS-REFERENCE TO RELATED APPLICATION(S)

The present application claims the benefit of priority of Japanese Patent Application No. 2013-159572 filed on Jul. 31, 2013. The disclosures of the application are incorporated herein by reference.

BACKGROUND

1. Technical Field

The present disclosure relates to a coil substrate, a method of manufacturing the coil substrate, and an inductor having the coil substrate.

2. Related Art

In recent years, the miniaturization of electronic equipment such as a smartphone and a game machine has been accelerated. With this, demands for the miniaturization of various elements such as an inductor mounted in electronic equipment have been made. For example, an inductor using a winding coil is known as an inductor mounted in such electronic equipment. The inductor using the winding coil is used in, e.g., a power-supply circuit of electronic equipment (see, e.g., Patent Document 1).

PRIOR ART LITERATURE

Patent Document

[Patent Document 1] JP-A-2003-168610

However, the limit to the miniaturization of the inductor using the winding coil is considered to be a planar shape size of about 1.6 millimeters (mm)×1.6 mm. Since there is limitation to the thickness of a winding, if the inductor is made to be smaller than this size, a rate of the volume of the winding to the total volume of the inductor is reduced, and the inductance of the inductor cannot be increased.

SUMMARY

Exemplary embodiments of the invention provide a coil substrate capable of being miniaturized as compared with a related-art one.

A coil substrate according to an exemplary embodiment of the invention, comprises:

a plurality of structural bodies, each of which comprises a first insulating layer, a wiring formed on the first insulating layer and configured to serve as a part of a spiral coil, and a second formed on the first insulating layer and configured to cover the wiring, wherein the plurality of structural bodies are stacked via an adhesion layer, and wherein the spiral coil is formed by series-connecting the wirings of adjacent ones of the plurality of structural bodies.

According to the exemplary embodiment, it is possible to provide a coil substrate capable of being miniaturized as compared with the related-art one.

DETAILED DESCRIPTION

Figure 1A:
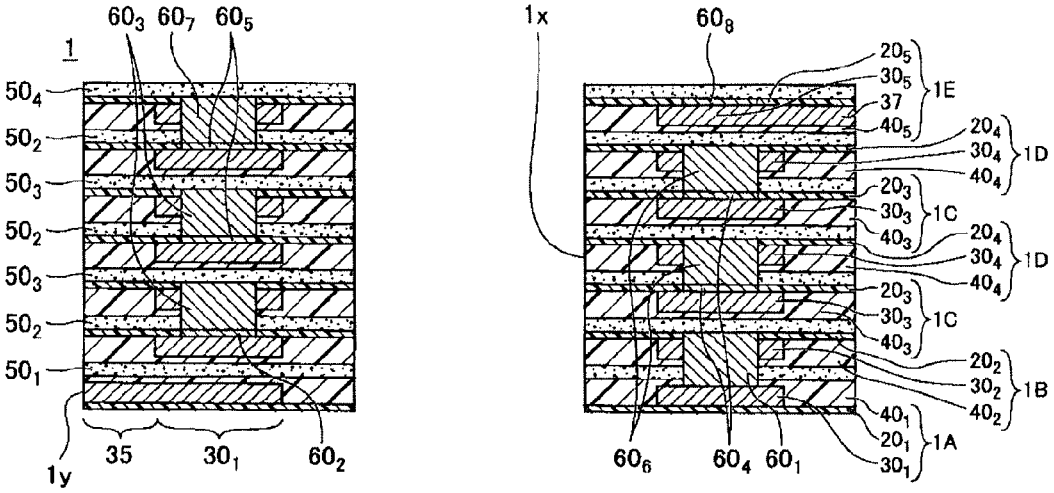
FIGS. 1A and 1B are views illustrating a coil substrate according to an embodiment.

Hereinafter, an embodiment for carrying out the invention is described with reference to the accompanying-drawings. In each drawing, same components are designated with a same reference numeral. Redundant descriptions of such components may be omitted.

[Structure of Coil Substrate]

Figure 1B:
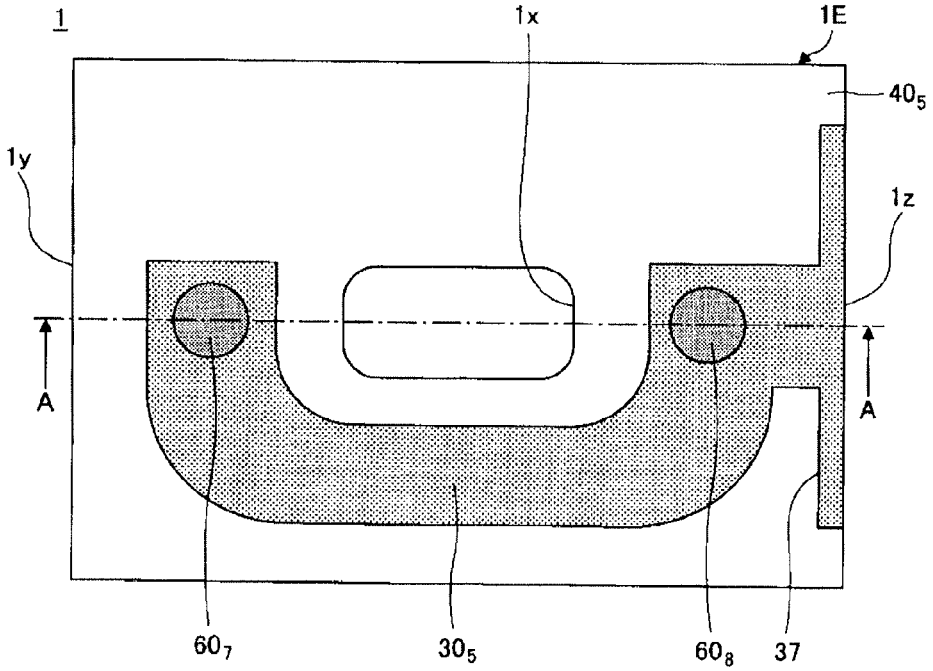

First, the structure of a coil substrate according to an embodiment is described hereinafter. FIGS. 1A and 1B are views illustrating a coil substrate according to the embodiment. FIG. 1B is a plan view illustrating the coil substrate, and FIG. 1A is a cross-sectional view taken along line A-A illustrated in FIG. 1B.

Referring to FIG. 1A, the coil substrate 1 includes a first structural body 1A, a second structural body 1B, a third structural body 1C, a fourth structural body 1D, a fifth structural body 1E, and adhesion layers $\mathbf{50}_1$ to $\mathbf{50}_4$. In FIG. 1B, an insulating layer $\mathbf{20}_5$ and the adhesion layer $\mathbf{50}_4$ are omitted. Drawings illustrating a manufacturing process will be referred to in the following description. In FIG. 1, reference numeral designating each opening portion is omitted expediently. Reference numerals in the drawings representing the manufacturing process will be referred to.

In the embodiment, the side of the adhesion layer $\mathbf{50}_4$ is referred to as an upper side or one side. The side of the insulating layer $\mathbf{20}_1$ is referred to as a lower side or the other side. The surface of the adhesion layer $\mathbf{50}_4$ side is referred to as an upper surface or one surface. The surface of the insulating layer $\mathbf{20}_1$ side is referred to as a lower surface or the other surface. The term "as viewed in plan view" designates "to view an object from a normal direction of a surface of the insulating layer $\mathbf{20}_1$". The term "planar shape" designates "an object's shape viewed from the normal direction of the surface of the insulating layer $\mathbf{20}_1$".

The planar shape of the coil substrate 1 can be set to, e.g., a rectangular shape having a size of about 1.6 millimeters (mm)×0.8 mm. The thickness of the coil substrate 1 can be set to, e.g., about 0.5 mm. A through-hole 1*x* is formed at the substantially central portion of the coil substrate 1.

The first structural body 1A has the insulating layer $\mathbf{20}_1$, a first wiring $\mathbf{30}_1$, a connecting portion 35, and an insulating layer $\mathbf{40}_1$. The insulating layer $\mathbf{20}_1$ is formed on the outermost layer (i.e., the bottom layer illustrated in FIG. 1A) of the coil substrate 1. For example, an epoxy-based insulating resin can be used as a material of the insulating layer $\mathbf{20}_1$. Other insulating resin such as polyimide and the like can be used as the material of the insulating layer $\mathbf{20}_1$. The thickness of the insulating layer $\mathbf{20}_1$ can be set to, e.g., 8 micrometers (m) to 12 μm.

The first wiring $\mathbf{30}_1$ and the connecting portion 35 are formed on the insulating layer $\mathbf{20}_1$. For example, copper (Cu) or the like can be used as materials of the first wiring $\mathbf{30}_1$ and the connecting portion 35. The thicknesses of the first wiring $\mathbf{30}_1$ and the connecting portion 35 can be set to, e.g., about 12 μm to 50 μm. The width of the first wiring $\mathbf{30}_1$ can be set to, e.g., about 50 μm to 130 μm. The first wiring $30_1$ is a first-layer wiring (i.e., about a half turn) serving as a part of a coil, and patterned in a substantially semi-ellipse shape as illustrated in FIG. 4B. In the first wiring $30_1$, the cross-sectional shape in a short direction (width direction) perpendicular to a longitudinal direction of the first wiring $30_1$ can be set to a substantially rectangle.

The connecting portion 35 is formed at an end portion of the first wiring $30_1$. A side surface of the connecting portion 35 is exposed from a side surface 1*y* of the coil substrate 1. The exposed part of the side surface of the connecting portion 35 serves as a part to be connected to an electrode of an inductor. As a matter of convenience, the connecting portion 35 is designated with reference numeral differing from reference numeral that designates the first wiring $30_1$. However, the connecting portion 35 is formed integrally with the first wiring $30_1$ in the same process.

The insulating layer $40_1$ is formed on the insulating layer $20_1$ so as to cover the first wiring $30_1$ and the connecting portion 35. That is, the first structural body 1A is a structural body including the insulating layer $20_1$, the first wiring $30_1$ and the connecting portion 35 formed on the insulating layer $20_1$, and the insulating layer $40_1$ formed on the insulating layer $20_1$ to cover the first wiring $30_1$ and the connecting portion 35. A part of the side surface of the connecting portion 35 is exposed from the insulating layer $40_1$. The insulating layer $40_1$ includes an opening portion (i.e., an opening portion $40_{11}$ illustrated in FIG. 6A). The opening portion $40_n$ is filled with a part of a via-wiring $60_1$ which is electrically connected to the first wiring $30_1$. For example, a photosensitive epoxy-based insulating resin can be used as the material of the insulating layer $40_1$. The thickness of the insulating layer $40_1$ (i.e., the thickness thereof from the top surface of the first wiring $30_1$) can be set to about 5 μm to 30 μm.

The second structural body 1B is stacked on the first structural body 1A via the adhesion layer $50_1$. The second structural body 1B includes an insulating layer $20_2$, a second wiring $30_2$, and an insulting layer $40_2$. For example, a heat-resistance adhesive agent such as an epoxy-based adhesive agent or a polyimide-based adhesive agent can be used as the adhesion layer $50_1$. The thickness of the adhesion layer $50_1$ can be set to, e.g., about 10 μm to 40 μm. Unless otherwise specified in the following description, the shapes, thicknesses, and materials of the insulating layers 20*n* and 40*n*, and the adhesion layer 50*n* ("n" is a natural number equal to or more than 2) are similar to those of the insulating layers $20_1$ and $40_1$, and the adhesion layer $50_1$.

The insulating layer 20*n* will be also referred to as the first insulating layer, and the insulating layer 40*n* will be also referred to as the second insulating layer in the following description. As a matter of convenience, the insulating layers 20*n* and 40*n* are designated with different reference numerals, respectively. However, each of the insulating layers 20*n* and 40*n* functions as an insulating layer covering the wiring. Thus, the insulating layers 20*n* and 40*n* will be also collectively referred to simply as insulating layers in the following description.

The insulating layer $40_2$ is stacked on the adhesion layer $50_1$. The second wiring $30_2$ is formed such that a bottom surface and a side surface of the second wiring $30_2$ are covered with the insulating layer $40_2$, and that a top surface of the wiring layer $30_2$ is exposed from the insulating layer $40_2$. The material and the thickness of the second wiring $30_2$ can be set to be similar to those of the first wring $30_1$, respectively. The second wiring $30_2$ is a second-layer wiring (i.e., about a half turn) that is a part of the coil. As illustrated in FIG. 5B, the second wiring $30_2$ is patterned in a substantially semi-ellipse shape which curves in a direction opposite to the direction of curve of the first wiring $30_1$ in FIG. 4B.

That is, the first wiring $30_1$ illustrated in FIG. 4B, and the second wiring $30_2$ illustrated in FIG. 5B form one turn of the coil having a substantially ellipse shape as viewed in plan view. The cross-sectional shape in a short direction of the second wiring $30_2$ can be set to a substantially rectangle. The insulating layer $20_2$ is stacked on the second wiring $30_2$ and the insulating layer $40_2$. That is, the second structural body 1B is a structural body obtained by vertically reversing a structural body including the insulating layer $20_2$, the second wiring $30_2$ formed on the insulating layer $20_2$, which serves as a part of the coil, and the insulating layer $40_2$ formed on the insulating layer $20_2$ so as to cover the second wiring $30_2$.

The second structural body 1B has an opening portion penetrating through the insulating layer $20_2$, the second wiring $30_2$, and the insulating layer $40_2$. A lower side of the opening portion communicates with the opening portions respectively formed in the adhesion layer $50_1$ and the insulating layer $40_1$. The opening portion (i.e., an opening portion $10_{23}$ illustrated in FIG. 6C) communicating therewith is filled with the via-wiring $60_1$. The second wiring $30_2$ is series-connected to the first wiring $30_1$ via the via-wiring $60_1$. The second structural body 1B also has an opening portion (i.e., an opening portion $10_{21}$ illustrated in FIG. 6C) penetrating through the insulating layer $20_2$ to expose the top surface of the second wiring $30_2$. The opening portion $10_{71}$ is filled with the via-wiring $60_2$. The second wiring $30_2$ is electrically connected to the via-wiring $60_2$.

In a layered product formed by stacking the second structural body 1B on the first structural body 1A, the first wiring $30_1$, the via-wiring $60_1$ and the second wiring $30_2$ are series-connected to form one turn of the coil.

The third structural body 1C is stacked on the second structural body 1B via the adhesion layer $50_2$. The third structural body 1C includes an insulating layer $20_3$, a third wiring $30_3$, and an insulating layer $40_3$.

The insulating layer $40_3$ is stacked on the adhesion layer $50_2$. The third wiring $30_3$ is formed so that a bottom surface and a side surface of the third wiring $30_3$ are covered with the insulating layer $40_3$, and that a top surface of the third wiring $30_3$ is exposed from the insulating layer $40_3$. The material and the thickness of the third wiring $30_3$ can be set to be similar to those of the first wiring $30_1$. The third wiring $30_3$ is a third-layer wiring (i.e., about a half turn) serving as a part of the coil, and patterned in a substantially semi-ellipse shape which curves in the same direction as the direction of the curve of the first wiring $30_1$ in FIG. 4B. The cross-sectional shape in a short direction of the third wiring $30_3$ can be set to a substantially rectangle. The insulating layer $20_3$ is stacked on the third wiring $30_3$ and the insulating layer $40_3$. That is, the third structural body 1C is a structural body obtained by vertically reversing a structural body including the insulating layer $20_3$, the third wiring $30_3$ formed on the insulating layer $20_3$, which serves as a part of the coil, and the insulating layer $40_3$ formed on the insulating layer $20_3$ so as to cover the third wiring $30_3$.

The third structural body 1C has an opening portion penetrating through the insulating layer $20_3$, the third wiring $30_3$, and the insulating layer $40_3$. A lower side of the opening portion communicates with the opening portion formed in the adhesion layer $50_2$. The opening portion (i.e., an opening portion $10_{33}$ illustrated in FIG. 7C) communicating therewith is filled with the via-wiring $60_3$. The via-wiring $60_3$ is electrically connected to the via-wiring $60_2$ formed in the opening portion of the insulating layer $20_2$ of the second structural body 1B. The third wiring $30_3$ is series-connected to the second wiring $30_2$ via the via-wirings $60_2$ and $60_3$. The third structural body 1C also has an opening portion (i.e., an opening portion $10_{32}$ illustrated in FIG. 7C) penetrating through the insulating layer $20_3$, to expose the top surface of the third wiring $30_3$. The opening portion $10_{32}$ is filled with the via-wiring $60_4$. The third wiring $30_3$ is electrically connected to the via-wiring $60_4$.

The fourth structural body 1D is stacked on the third structural body 1C via the adhesion layer $50_3$. The fourth structural body 1D includes an insulating layer $20_4$, a fourth wiring $30_4$, and an insulating layer $40_4$.

The insulating layer $40_4$ is stacked on the adhesion layer $50_3$. The fourth wiring $30_4$ is formed such that a bottom surface and a side surface of the fourth wiring $30_4$ are covered with the insulating layer $40_4$, and that a top surface of the wiring layer $30_4$ is exposed from the insulating layer $40_4$. The material and the thickness of the fourth wiring $30_4$ can be set to be similar to those of the first wring $30_1$, respectively. The fourth wiring $30_4$ is a fourth-layer wiring (i.e., about a half turn) that is a part of the coil. As illustrated in FIG. 5B, the fourth wiring $30_4$ is patterned in a substantially semi-ellipse shape which curves in a direction opposite to the direction of the curve of the first wiring $30_1$ in FIG. 4B.

That is, the third wiring $30_3$ and the fourth wiring $30_4$ form one turn of the coil having a substantially ellipse shape as viewed in planer view. The cross-sectional shape in a short direction of the fourth wiring $30_4$ can be set to a substantially rectangle. The insulating layer $20_4$ is stacked on the fourth wiring $30_4$ and the insulating layer $40_4$. That is, the fourth structural body 1D is a structural body obtained by vertically reversing a structural body including the insulating layer $20_4$, the fourth wiring $30_4$ formed on the insulating layer $20_4$, which serves as a part of the coil, and the insulating layer $40_4$ formed on the insulating layer $20_4$ so as to cover the fourth wiring $30_4$.

The fourth structural body 1D has an opening portion penetrating through the insulating layer $20_4$, the fourth wiring $30_4$, and the insulating layer $40_4$. A lower side of the opening portion communicates with the opening portion formed in the adhesion layer $50_3$. The opening portion communicating therewith is filled with the via-wiring $60_6$. The via-wiring $60_6$ is electrically connected to the via-wiring $60_4$ formed in the opening portion of the insulating layer $20_3$ of the third structural body 1C. The fourth wiring $30_4$ is series-connected to the third wiring $30_3$ via the via-wirings $60_4$ and $60_6$. The fourth structural body 1D also has an opening portion penetrating through the second insulating layer $20_4$ to expose the top surface of the fourth wiring $30_4$. The opening portion is filled with the via-wiring $60_5$. The fourth wiring $30_4$ is electrically connected to the via-wiring $60_5$.

In a layered product formed by stacking the fourth structural body 1D on the third structural body 1C, the third wiring $30_3$, the via-wirings $60_4$ and $60_6$, the fourth wiring $30_4$ are series-connected to form one turn of the coil. In a layered product formed by stacking the first structural body 1A to the fourth structural body 1D, the first wiring $30_1$, the via-wiring $60_1$, the second wiring $30_2$, the via-wirings $60_2$ and $60_3$, the third wiring $30_3$, the via-wirings $60_4$ and $60_6$, and the fourth wiring $30_4$ are series-connected to form two turns of the coil.

The third structural body 1C is stacked again on the fourth structural body 1D via the adhesion layer $50_2$. The fourth structural body 1D is stacked again thereon via the adhesion layer $50_3$. A plurality of unit-structural bodies (each having one turn of the coil), each of which includes one set of the third structural body 1C and the fourth structural body 1D, are stacked via the adhesion layers according to a necessary number of windings. Then, adjacent unit-structural bodies are series-connected to each other, so that a coil having an optional number of windings can be formed. FIG. 1A illustrates an example of forming two unit-structural bodies, each of which has a set of the third structural body 1C and the fourth structural body 1D.

The fifth structural body 1E is stacked on the upper fourth structural body 1D via the adhesion layer $50_2$. The fifth structural body 1E includes an insulating layer $20_5$, a fifth wiring $30_5$, a connecting portion 37, and an insulating layer $40_5$.

The insulating layer $40_5$ is stacked on the adhesion layer $50_2$. Each of the fifth wiring $30_5$ and the connecting portion 37 is formed so that a bottom surface and a side surface thereof is covered with the insulating layer $40_5$, and that a top surface thereof is exposed from the insulating layer $40_5$. The material and the thickness of each of the fifth wiring $30_5$ and the connecting portion 37 can be set to be similar to those of the first wiring $30_1$. The fifth wiring $30_5$ is an uppermost-layer wiring and patterned in a substantially semi-ellipse shape as illustrated in FIG. 1B.

The connecting portion 37 is formed at one end portion of the fifth wiring $30_5$. A side surface of the connecting portion 37 is exposed from the other side surface 1*z* of the coil substrate 1. The exposed part of the side surface of the connecting portion 37 is a part to be connected to an electrode of the inductor. As a matter of convenience, the connecting portion 37 is designated with reference numeral differing from reference numeral that designates the fifth wiring $30_5$. However, the connecting portion 37 is formed integrally with the fifth wiring $30_5$ in the same process. The insulating layer $20_5$ is formed on each of the fifth wiring $30_5$, the connecting portion 37, and the insulating layer $40_5$. That is, the fifth structural body 1E is a structural body obtained by vertically reversing a structural body including the insulating layer $20_5$, the fifth wiring $30_5$ and the connecting portion 37 which serve as a part of the coil formed on the insulating layer $20_5$, and an insulating layer $40_5$ formed on the insulating layer $20_5$ by covering the fifth wiring $30_5$ and the connecting portion 37.

The fifth structural body 1E has an opening portion that penetrates through the insulating layer $20_5$, the fifth wiring $30_5$, and the insulating layer $40_5$, and that communicates with an opening portion of the adhesion layer $50_2$ at a lower side thereof. The opening portion is filled with a via-wiring $60_7$. The via-wiring $60_7$ is electrically connected to the via-wiring $60_5$ formed in the opening portion of the insulating layer $20_4$ of the fourth structural body 1D. The fifth structural body 1E also has an opening portion that penetrates through the insulating layer $20_5$ to expose the top surface of the fifth wiring $30_5$. The opening portion is filled with the via-wiring $60_8$.

The fifth wiring $30_5$ is series-connected to the fourth wiring $30_4$ via the via-wirings $60_5$ and $60_7$. As mentioned above, in the coil substrate 1, the wirings of the adjacent structural bodies are series-connected to one another, so that a spiral coil extending from the connecting portion 35 to the connecting portion 37 is formed.

The adhesion layer $50_4$ is stacked on the fifth structural body 1E to be an outermost layer (i.e., the top layer illustrated in FIG. 1A) of the coil substrate 1. No opening portion is formed in the adhesion layer $50_4$. That is, an upper side of the coil substrate 1 is covered with the adhesion layer $50_4$ functioning as an insulating layer. Thus, no electrical-conductor is exposed.

Figure 2:
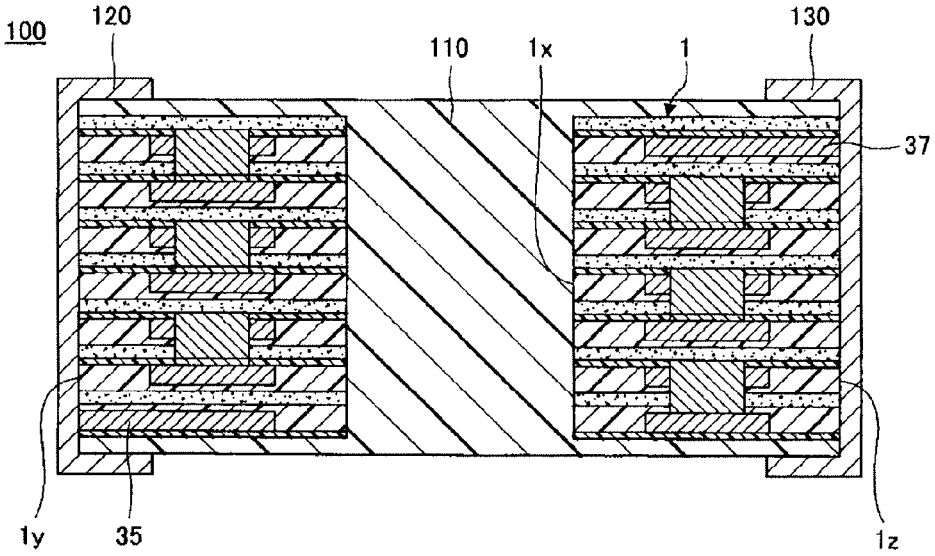
FIG. 2 is a cross-sectional view illustrating an inductor according to the embodiment.

FIG. 2 is a cross-sectional view illustrating an inductor according to the embodiment. Referring to FIG. 2, an inductor 100 is a chip inductor in which the coil substrate 1 is sealed with a sealing resin 110 and electrodes 120 and 130 are formed on an exterior of the sealing resin 110. The planar shape of the inductor 100 can be set to, e.g., a rectangle having a size of about 1.6 mm×0.8 mm. The thickness of the coil substrate 1 can be set to, e.g., about 1.0 mm. The inductor 100 can be used in, e.g., a voltage conversion circuit of a compact electronic device.

In the inductor 100, the sealing resin 110 seals the coil substrate 1 excepting the side surface 1*y* and the other side surface 1*z* of the coil substrate 1. That is, the sealing resin 110 covers the coil substrate 1 excepting a part of side surfaces of the connecting portions 35 and 37 of the coil substrate 1. The sealing resin 110 is formed even in the through-hole 1*x*. For example, a molding resin containing fillers made of a magnetic material such as a ferrite or the like can be used as the sealing resin 110. The magnetic material has the function of increasing the inductance of the inductor 100. Thus, the through-hole 1*x* is formed in the coil substrate 1 and filled with the molding resin containing the magnetic material or the like. Consequently, the inductance of the inductor can be more enhanced. A core made of a magnetic material such as a ferrite may be arranged in the through-hole 1*x*, and a sealing resin 110 may be formed by sealing the coil substrate 1 including the core. The shape of the core can be set to, e.g., a cylinder or a rectangular parallelepiped.

The electrode 120 is formed on the exterior of the sealing resin 110, and electrically connected to the part of the connecting portion 35. More specifically, the electrode 120 is continuously formed on the one side surface, and a part of each of the top surface and the bottom surface of the sealing resin 110. An inner wall surface of the electrode 120 has contact with the side surface of the connecting portion 35 exposed from one side surface 1*y* of the coil substrate 1. The inner wall surface of the electrode 120 and the side surface of the connecting portion 35 are electrically connected to each other.

The electrode 130 is formed on the exterior of the sealing resin 110, and electrically connected to the part of the connecting portion 37. More specifically, the electrode 130 is continuously formed on the other side surface, and a part of each of the top surface and the bottom surface of the sealing resin 110. An inner wall surface of the electrode 130 has contact with the side surface of the connecting portion 37 exposed from the other side surface 1*z* of the coil substrate 1. The inner wall surface of the electrode 130 and the side surface of the connecting portion 37 are electrically connected to each other. For example, copper (Cu) or the like may be used as the material of the electrodes 120 and 130. The electrode 120 and 130 can be formed by, e.g., the application of copper paste, the sputtering of copper, electroless plating or the like. The electrodes 120 and 130 may be formed to have a structure in which plural metal layers are stacked.

[Method of Manufacturing Coil Substrate]

Figure 10A:
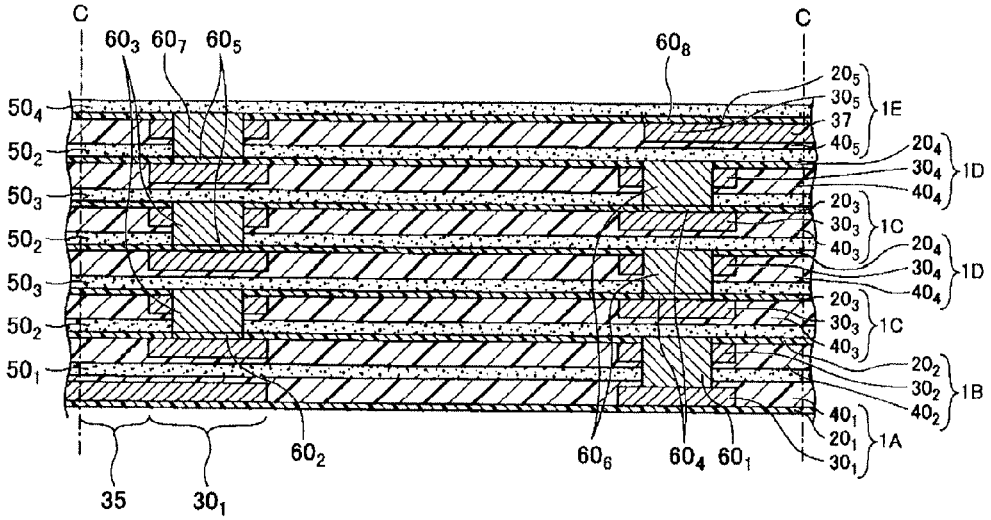
Figure 10B:
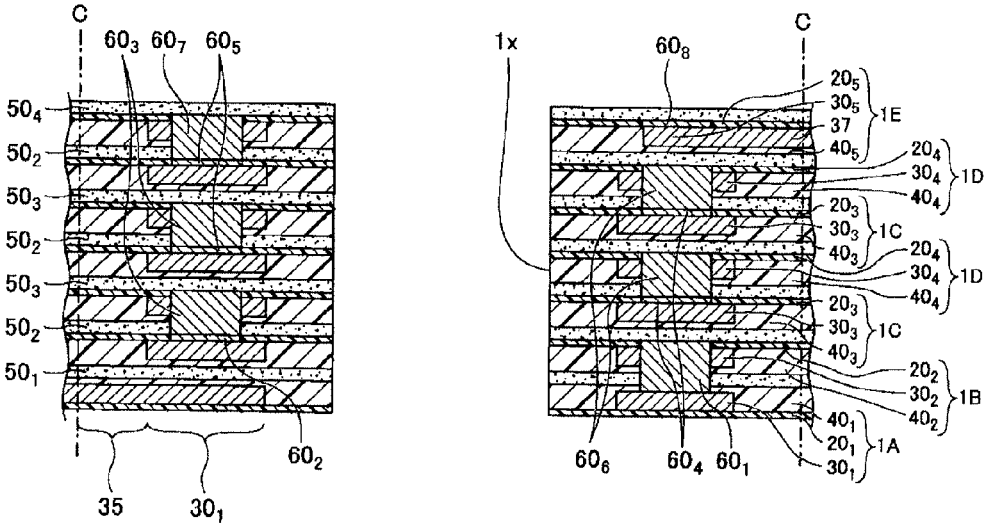
Figure 11:
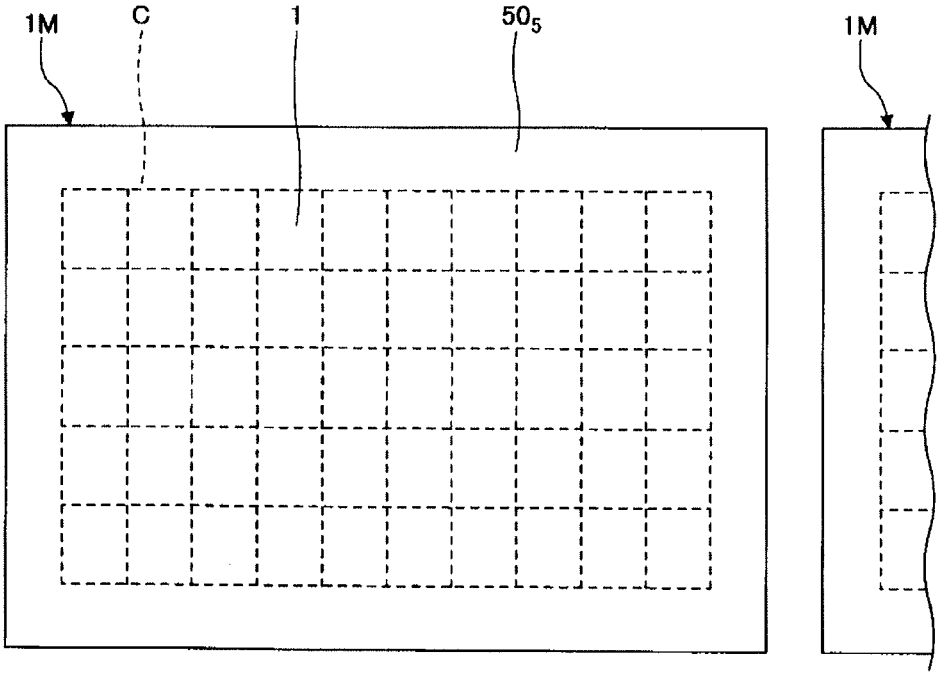

Next, a method of manufacturing the coil substrate according to the embodiment is described hereinafter. FIGS. 3A to 11 are views illustrating a process of manufacturing the coil substrate according to the embodiment. Cross-sectional views included in FIGS. 4A to 10B correspond to FIG. 3B. FIG. 11 is a plan view corresponding to FIG. 3A.

Figure 3A:
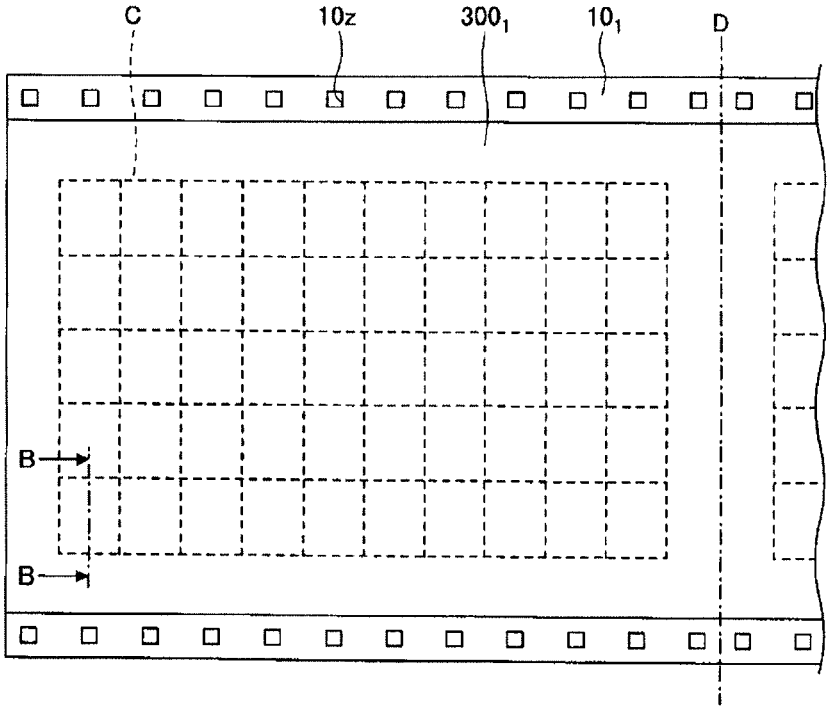
FIGS. 3A to 11 are views illustrating a process of manufacturing the coil substrate according to the embodiment.
Figure 3B:
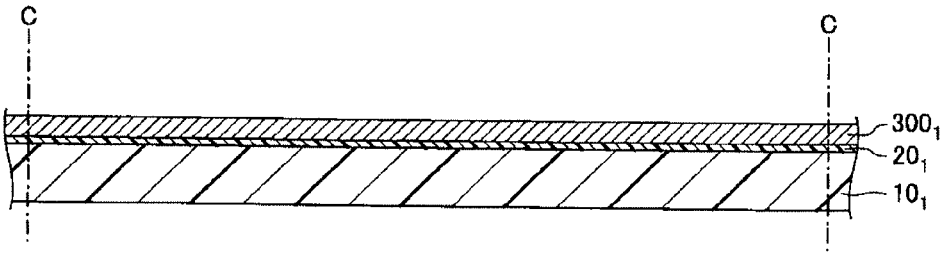

First, in the process illustrated in FIGS. 3A and 3B (FIG. 3A is a plan view, and FIG. 3B is a cross-sectional view taken on line B-B illustrated in FIG. 3A), e.g., a reel-like (or tape-like) flexible insulating resin film is prepared as a substrate (first substrate) $\mathbf{10}_1$. Then, sprocket holes 10*z* are consecutively formed at each of both ends in a short direction of the substrate $\mathbf{10}_1$ (i.e., in a vertical direction in the drawing) along a longitudinal direction (i.e., a lateral direction in the drawing) of the substrate $\mathbf{10}_1$ at substantially uniform intervals. Then, the insulating layer $\mathbf{20}_1$ and a metal foil $\mathbf{300}_1$ are stacked in order on a surface of the substrate $\mathbf{10}_1$ at a region excepting both end portions of the substrate $\mathbf{10}_1$ in which the sprocket holes 10*z* are formed. More specifically, e.g., a semi-cured insulating layer $\mathbf{20}_1$ and a metal foil $\mathbf{300}_1$ are stacked in order on the surface of the substrate $\mathbf{10}_1$ and heated to thereby cure the semi-cured insulating layer $\mathbf{20}_1$.

Plural regions C indicated with dashed lines placed between both end portions of the substrate $\mathbf{10}_1$, on which the sprocket holes 10*z* are formed, are finally individualized by being cut along the dashed lines. Each of the regions C (hereinafter referred to as an individual region C) is a region to be used as a coil substrate 1. FIG. 3B illustrates a cross-section taken along line B-B illustrated in FIG. 3A. The individual regions C can be arranged, e.g., in a matrix in a plane. The plural individual regions C may be arranged to be in contact with one another, as illustrated in FIG. 3A. Alternatively, the plural individual regions C may be arranged at predetermined intervals in a line. The number of the individual regions C and the number of the sprocket holes 10*z* can be determined optionally. Line D indicates a cutting position (hereinafter referred to as a cutting position D) for cutting the reel-like (or tape-like) substrate $\mathbf{10}_1$ in a post-process into sheet-like regions.

For example, a polyphenylene-sulfide film, a polyimide film, a polyethylene-naphthalate film, or the like can be used as the substrate $\mathbf{10}_1$. If the polyphenylene-sulfide film is used as the substrate $\mathbf{10}_1$, the substrate $\mathbf{10}_1$ and the insulating layer $\mathbf{20}_1$ can easily be separated from each other in the post-process. The thickness of the substrate $\mathbf{10}_1$ can be set to, e.g., about 50 μm to 75 μm.

For example, a film-like epoxy-based insulating resin can be used as the insulating layer $\mathbf{20}_1$. Alternatively, liquid-like or paste-like epoxy-based insulating resin or the like may be used as the insulating layer $\mathbf{20}_1$. The thickness of the insulating layer $\mathbf{20}_1$ can be set to, e.g., about 8 μm to 12 μm. The metal foil $\mathbf{300}_1$ becomes the first wiring $\mathbf{30}_1$ and the connecting portion 35 finally. For example, a copper foil can be used as metal foil $\mathbf{300}_1$. The thickness of the metal foil $\mathbf{300}_1$ can be set to, e.g., about 12 μm to 50 μm.

The sprocket holes 10*z* are through-holes that mesh with pins of the sprockets driven by a motor or the like when the substrate $\mathbf{10}_1$ is mounted in various manufacturing apparatuses in a process of manufacturing the coil substrate 1, and that are used for the pitch-feeding of the substrate $\mathbf{10}_1$. The width (in a direction perpendicular to an arrangement direction of the sprocket holes 10*z*) of the substrate $\mathbf{10}_1$ is determined so as to meet with the manufacturing apparatus in which the substrate $\mathbf{10}_1$ is mounted.

The width of the substrate $\mathbf{10}_1$ can be set to, e.g., about 40 μm to 90 μm. Meanwhile, the length (in the arrangement direction of the sprocket holes 10*z*) of the substrate $\mathbf{10}_1$ can be determined optionally. In FIG. 3A, the individual regions C are arranged in 5-rows by 10-columns. However, the number of columns in the arrangement of the individual regions C can be set to about 100 by increasing the length of the substrate $\mathbf{10}_1$.

Figure 4A:
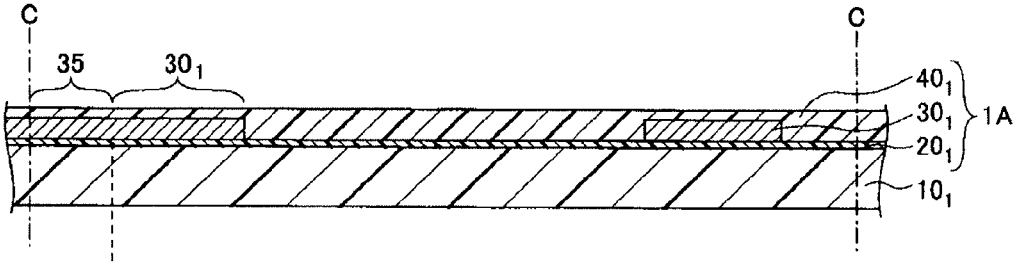
Figure 4B:
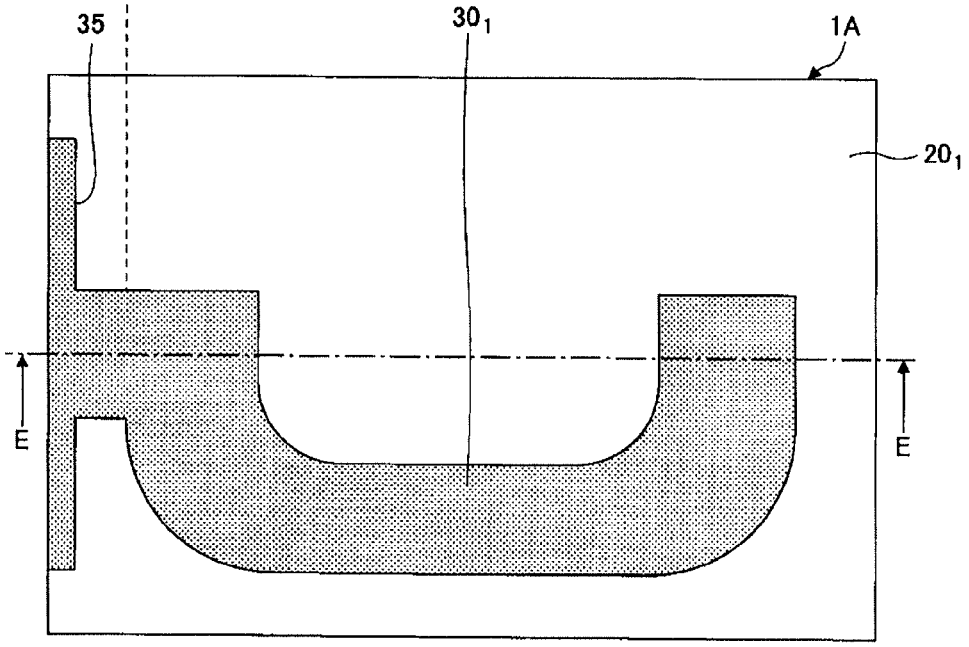

Next, in a process illustrated in FIGS. 4A and 4B (FIG. 4B is a plan view, and FIG. 4A is a cross-sectional view taken along line E-E illustrated in FIG. 4B), the first structural body 1A is manufactured in which the first wiring $\mathbf{30}_1$ that serves as a first-layer wiring (i.e., about a half turn) that is a part of the coil is formed. More specifically, the metal foil $\mathbf{300}_1$ illustrated in FIG. 3B is patterned in a substantially semi-ellipse shape. Thus, the first wiring $\mathbf{30}_1$ is formed on the insulating layer $\mathbf{20}_1$. The connecting portion 35 is formed at one end portion of the first wiring $\mathbf{30}_1$. The cross-sectional shape in the short direction of the first wiring $\mathbf{30}_1$ can be set to a substantially rectangle.

The patterning of the metal foil $\mathbf{300}_1$ can be performed by, e.g., a photolithography method. That is, a photosensitive resist is applied on the metal foil $\mathbf{300}_1$. Then, an opening portion is formed in the resist by exposing and developing a predetermined region. The metal foil $\mathbf{300}_1$ exposed in the opening portion is removed by etching. Thus, the patterning of the metal foil $\mathbf{300}_1$ can be performed. The first wiring $\mathbf{30}_1$ and the connecting portion 35 are formed as a continuous single wiring.

Then, the first wiring $\mathbf{30}_1$ and the connecting portion 35 are covered with the insulating layer $\mathbf{40}_1$. The insulating layer $\mathbf{40}_1$ can be formed by laminating, e.g., film-like photosensitive epoxy-based insulating resin or the like. Alternatively, the insulating layer $\mathbf{40}_1$ can be formed by applying, e.g., liquid-like or paste-like photosensitive epoxy-based insulating resin or the like. The thickness of the insulating layer $\mathbf{40}_1$ (i.e., a thickness from the top surface of the first wiring $\mathbf{30}_1$) can be set to, e.g., about 5 μm to 30 μm. In FIG. 4B, the insulating layer $\mathbf{40}_1$ is omitted.

Figure 5A:
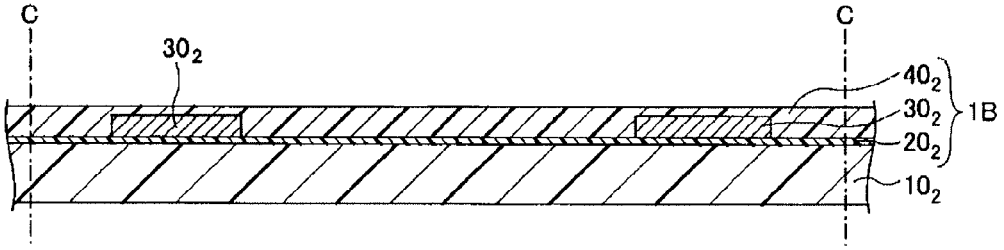
Figure 5B:
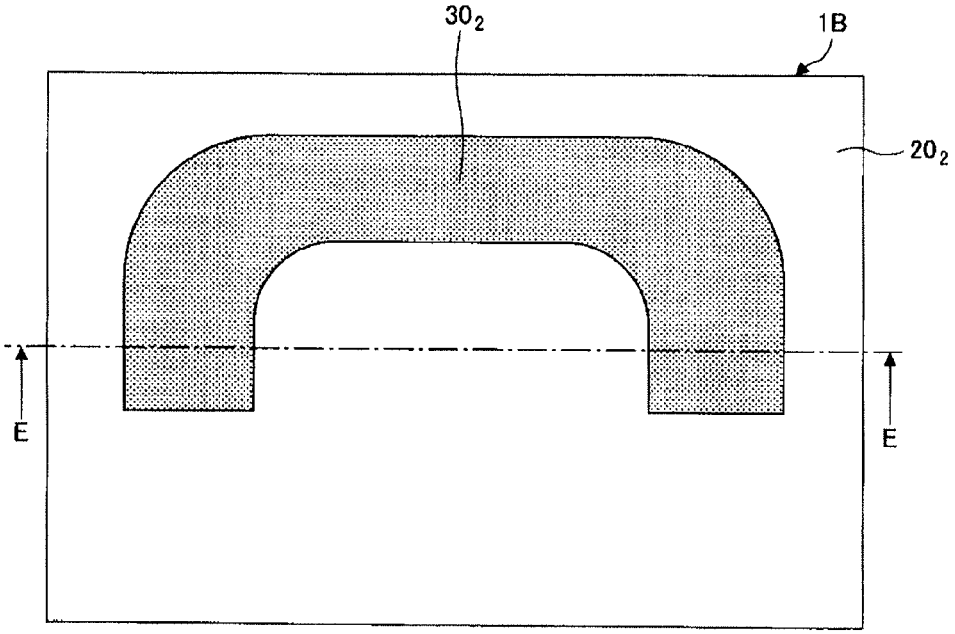

Next, in a process illustrated in FIGS. 5A and 5B (FIG. 5B is a plan view, and FIG. 5A is a cross-sectional view taken on line E-E illustrated in FIG. 5B), the second structural body 1B is manufactured in which the second wiring $\mathbf{30}_2$ serving as a second-layer wiring (i.e., about a half turn) that is a part of the coil. More specifically, similarly to the process illustrated in FIG. 3, the sprocket holes 10*z* are formed in the substrate $\mathbf{10}_2$. Then, the insulating layer $\mathbf{20}_2$ and the metal foil $\mathbf{300}_2$ (not shown) are stacked in order on the substrate $\mathbf{10}_2$ at a region excepting both end portions of the substrate $\mathbf{10}_2$ in which the sprocket holes 10*z* are formed.

Then, similarly to the process illustrated in FIG. 4, the metal foil $\mathbf{300}_2$ is patterned, so that the second wiring $\mathbf{30}_2$ is formed, which is patterned in a substantially semi-ellipse shape as illustrated in FIG. 5B, on the insulating layer $\mathbf{20}_2$. Then, the second wiring $\mathbf{30}_2$ is covered with the insulating layer $\mathbf{40}_2$. Unless otherwise specified in the following description, the shapes, thicknesses, and materials of an insulating layer 10*n* and the metal foil 300*n* ("n" is a natural number equal to or more than 2) are similar to those of the insulating layer $\mathbf{10}_1$, and the metal foil $\mathbf{300}_1$. In FIG. 5B, the insulating layer $\mathbf{40}_2$ is omitted.

Figure 6A:
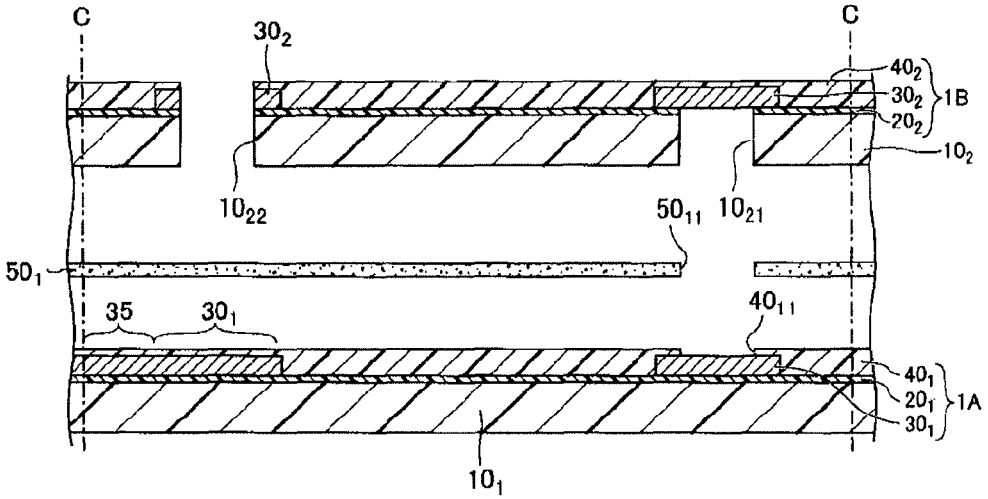

Next, in a process illustrated in FIG. 6A, the opening portion $\mathbf{40}_{11}$ exposing the top surface of the first wiring $\mathbf{30}_1$ is formed in the insulating layer $\mathbf{40}_1$ of the first structural body 1A. The opening portion $\mathbf{10}_{21}$ exposing the bottom surface of the second wiring $\mathbf{30}_2$ is formed in the substrate $\mathbf{10}_2$ and the insulating layer $\mathbf{20}_2$ of the second structural body 1B. An opening portion (through-hole) $\mathbf{10}_{22}$ is formed which penetrates through the substrate $\mathbf{10}_2$, the insulating layer $\mathbf{20}_2$, the second wiring $\mathbf{30}_2$, and the insulating layer $\mathbf{40}_2$ of the second structural body 1B.

An adhesion layer $\mathbf{50}_1$ is prepared. An opening portion (through-hole) $\mathbf{50}_{11}$ penetrating through the adhesion layer $\mathbf{50}_1$ is formed. For example, a heat-resistant (thermosetting) insulating resin adhesive agent, such as an epoxy-based adhesive agent or a polyimide-based adhesive agent, can be used as the adhesion layer $\mathbf{50}_1$. The thickness of the adhesion layer $\mathbf{50}_1$ can be set to, e.g., about 10 μm to 40 μm. The opening portions $\mathbf{40}_{11}$, $\mathbf{50}_{11}$, and $\mathbf{10}_{22}$ are respectively formed at positions as viewed in plan view, which overlap with one another when the first structural body 1A, the adhesion layer $\mathbf{50}_1$, and the second structural body 1B are stacked in a predetermined direction. The planar shape of each of the opening portions $\mathbf{40}_{11}$, $\mathbf{10}_{21}$, $\mathbf{10}_{22}$, and $\mathbf{50}_{11}$ can be set to, e.g., a circle whose diameter is about 150 μm. Each of these opening portions can be formed by press-working, laser-processing, or the like.

Figure 6B:
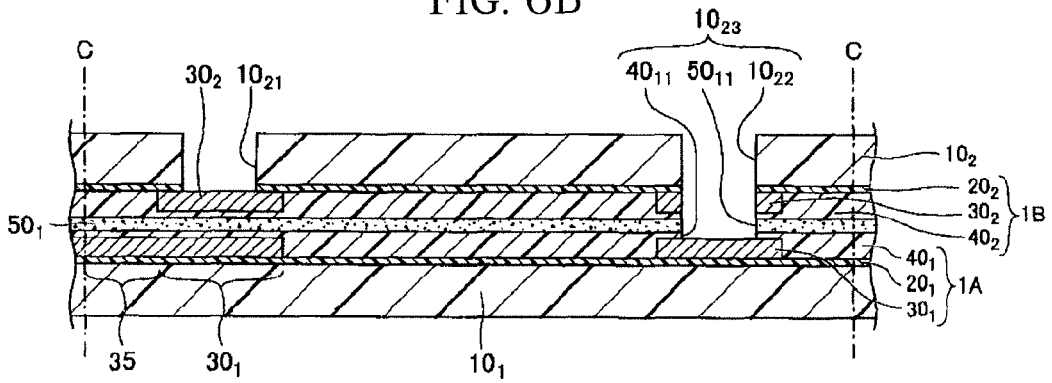

Next, in a process illustrated in FIG. 6B, the substrate $\mathbf{10}_2$ and the second structural body 1B are inverted from a state illustrated in FIG. 6A, and stacked on the first structural body 1A via the adhesion layer $\mathbf{50}_1$. That is, the first structural body 1A and the second structural body 1B are placed opposite to each other via the adhesion layer $\mathbf{50}_1$, and stacked so as to place the substrate $\mathbf{10}_1$ and the substrate $\mathbf{10}_2$ on the outer side. Then, the adhesion layer $\mathbf{50}_1$ is cured. At that time, the opening portions $\mathbf{40}_{11}$, $\mathbf{50}_{11}$, and $\mathbf{10}_{22}$ communicate with one another so as to form one opening portion $\mathbf{10}_{23}$, from the bottom of which the top surface of the first wiring $\mathbf{30}_1$ is exposed. The position, at which each of the opening portions $\mathbf{10}_{21}$ and $\mathbf{10}_{23}$ is formed, is a position, at which the opening portion overlaps with an associated one of the via-wirings $\mathbf{60}_7$ and $\mathbf{60}_8$ of FIG. 1A, as viewed in plan view.

However, in FIGS. 6A and 6B, the second structural body 1B may be stacked on the first structural body 1A via the adhesion layer $\mathbf{50}_1$ before each opening portion is provided therein. Then, the opening portions $\mathbf{10}_{21}$ and $\mathbf{10}_{23}$ may be provided in the second structural body 1B.

Figure 6C:
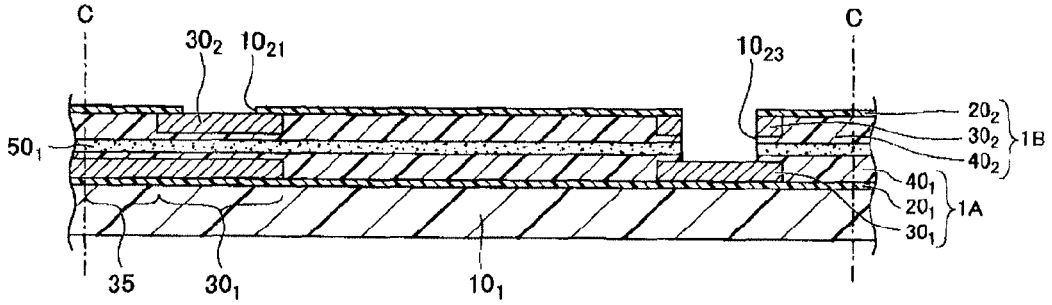

Next, in a process illustrated in FIG. 6C, the substrate $\mathbf{10}_2$ is removed (or peeled) from the insulating layer $\mathbf{20}_2$ of the second structural body 1B. If a polyphenylene-sulfide film is used as the substrate $\mathbf{10}_2$, the substrate $\mathbf{10}_2$ and the insulating layer $\mathbf{20}_2$ can easily be peeled from each other.

Figure 7A:
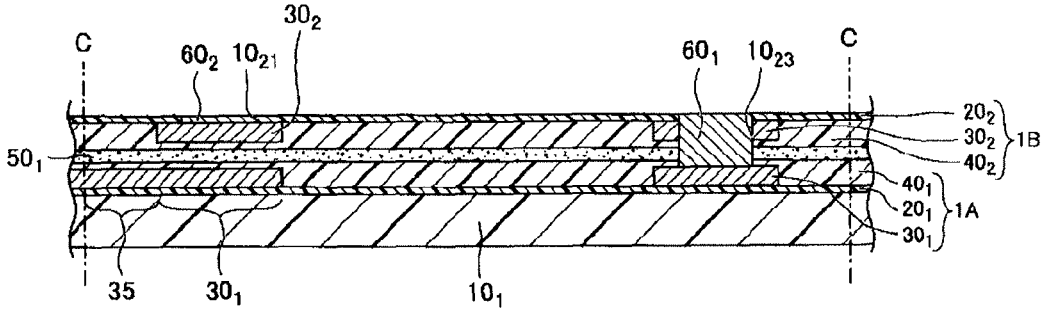
Figure 7A:
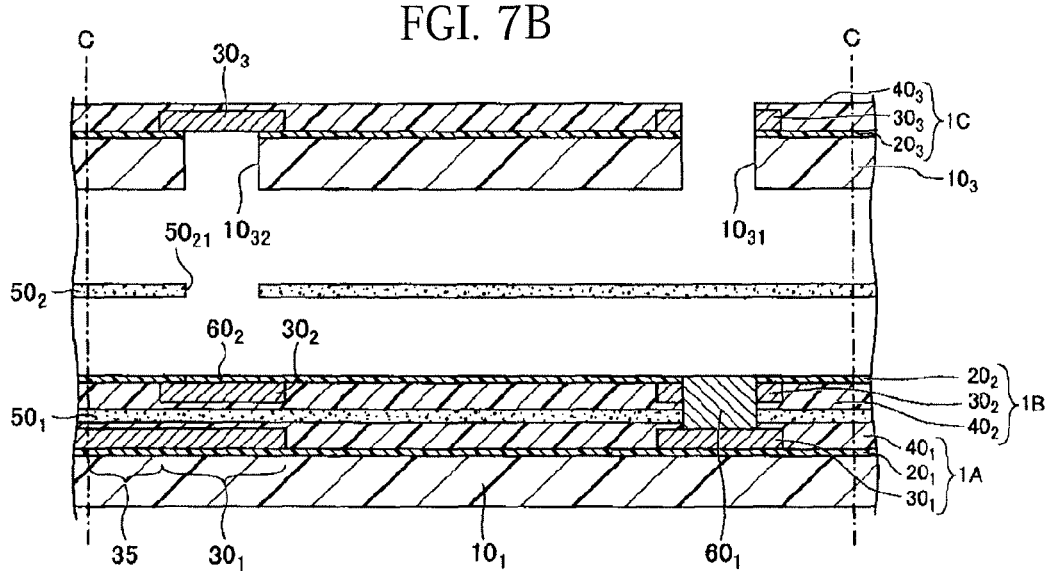

Next, in a process illustrated in FIG. 7A, for example, the via-wiring $\mathbf{60}_1$ is formed by filling metal paste such as copper (Cu) paste, on the first wiring $\mathbf{30}_1$ exposed at the bottom portion of the opening portion $\mathbf{10}_{23}$. The first wiring $\mathbf{30}_1$ and the second wiring $\mathbf{30}_2$ are series-connected to each other via the via-wiring $\mathbf{60}_1$. For example, the via-wiring $\mathbf{60}_2$ is formed by filling metal paste such as copper (Cu) paste on the second wiring $\mathbf{30}_2$ exposed at the bottom portion of the opening portion $\mathbf{10}_{21}$. The second wiring $\mathbf{30}_2$ and the via-wiring $\mathbf{60}_2$ are electrically connected to each other.

The via-wirings $\mathbf{60}_1$ and $\mathbf{60}_2$ may be formed by precipitating copper (Cu) from the first wiring $\mathbf{30}_1$ and the second wiring $\mathbf{30}_2$, respectively, through an electrolytic plating method. The top surface of each of the via-wirings $\mathbf{60}_1$ and $\mathbf{60}_2$ can be set to be substantially flush with the top surface of the insulating layer $\mathbf{20}_2$. In the layered structural body in which the second structural body 1B is stacked on the first structural body 1A, one turn of the coil is formed by series-connecting the first wiring $\mathbf{30}_1$, the via-wiring $\mathbf{60}_1$, and the second wiring $\mathbf{30}_2$ through this process.

Next, in a process illustrated in FIG. 7B, the third structural body 1C is manufactured, in which the third wiring $\mathbf{30}_3$ that serves as a third-layer wiring (i.e., about a half turn) that is a part of the coil is formed on the substrate $\mathbf{10}_3$, similarly to the process illustrated in FIGS. 3A to 4B. However, no part corresponding to the connecting portion 35 is formed in the third structural body 1C. Then, similarly to the process illustrated in FIG. 6A, an opening portion (through-hole) $\mathbf{10}_{31}$ is formed, which penetrates through the substrate $\mathbf{10}_3$, the insulating layer $\mathbf{20}_3$ of the third structural body 1C, the third wiring $\mathbf{30}_3$, and the insulating layer $\mathbf{40}_3$. An opening portion $\mathbf{10}_{32}$, from which the bottom surface of the third wiring $30_3$ is exposed, is formed in the substrate $10_3$, and the insulating layer $20_3$ of the third structural body 1C.

The adhesion layer $50_2$ is prepared, and an opening portion (through-hole) $50_{21}$ penetrating through the adhesion layer $50_2$ is formed. The opening portions $10_{31}$ and $50_{21}$ are formed at positions that overlap with each other as viewed in plan view when the second structural body 1B, the adhesion layer $50_2$, and the third structural body 1C are stacked in a predetermined direction. The planar shape of each of the opening portions $10_{31}$, $10_{32}$, and $50_{21}$ can be set to, e.g., a circular-shape whose diameter is about 150 μm. Each of the opening portions can be formed by press-working, laser-processing, or the like.

Figure 7C:
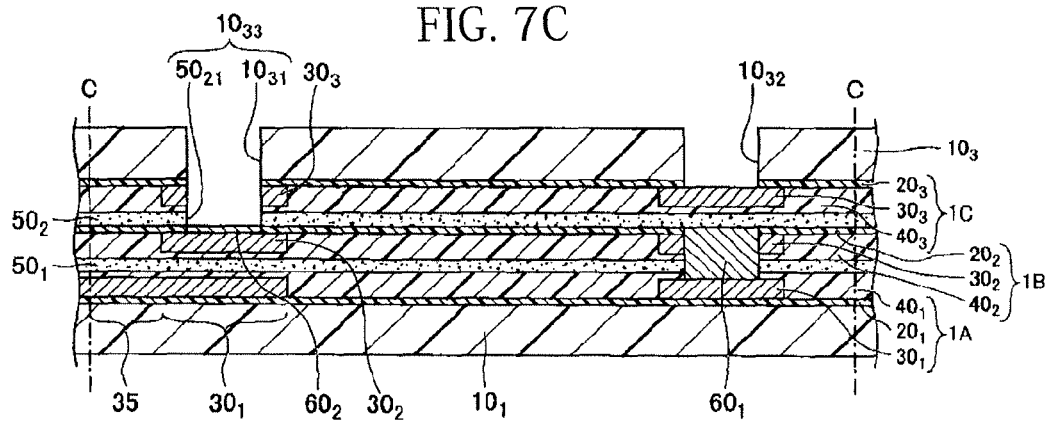

Next, in a process illustrated in FIG. 7C, similarly to the process illustrated in FIG. 6B, the substrate $10_3$ and the third structural body 1C are inverted from the state illustrated in FIG. 7B, and stacked on the second structural body 1B via the adhesion layer $50_2$. Then, the adhesion layer $50_2$ is cured. At that time, the opening portions $10_{31}$ and $50_{21}$ communicate with each other, so that one opening portion $10_{33}$ is formed, and that the top surface of the via-wiring $60_2$ is exposed at the bottom part of the opening portion $10_{33}$. The position at which each of the opening portions $10_{33}$ and $10_{32}$ is formed can be set to a position at which the opening portion overlaps with an associated one of the via-wirings $60_7$ and $60_8$ of FIG. 1 as viewed in plan view.

Figure 8A:
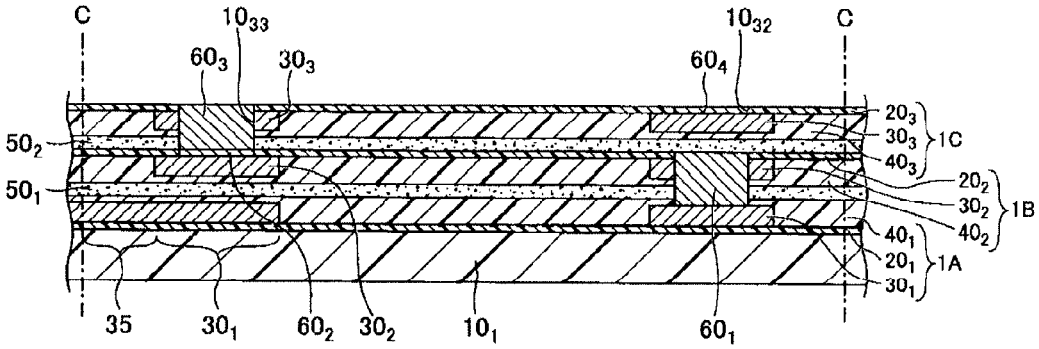

Next, in a process illustrated in FIG. 8A, similarly to the process illustrated in FIG. 6C, the substrate $10_3$ is peeled from the insulating layer $20_3$. Then, similarly to the process illustrated in FIG. 7A, for example, the via-wiring $60_3$ is formed by filling, e.g., metal paste such as copper (Cu) paste on the via-wiring $60_2$ exposed at the bottom part of the opening portion $10_{33}$. The via-wirings $60_2$ and $60_3$ are electrically connected to each other. The second wiring $30_2$ and the third wiring $30_3$ are series-connected to each other via the via-wirings $60_2$ and $60_3$.

For example, the via-wiring $60_4$ is formed by filling, e.g., metal paste such as copper (Cu) paste on the third wiring $30_3$ exposed at the bottom part of the opening portion $10_{32}$. The third wiring $30_3$ and the via-wiring $60_4$ are electrically connected to each other. The via-wirings $60_3$ and $60_4$ may be respectively formed by precipitating copper (Cu) from the via-winding $60_2$ and the third wiring $30_3$ through an electrolytic plating method. The top surface of each of the via-wirings $60_3$ and $60_4$ can be set to be substantially flush with the top surface of the insulating layer $20_3$.

Figure 8B:
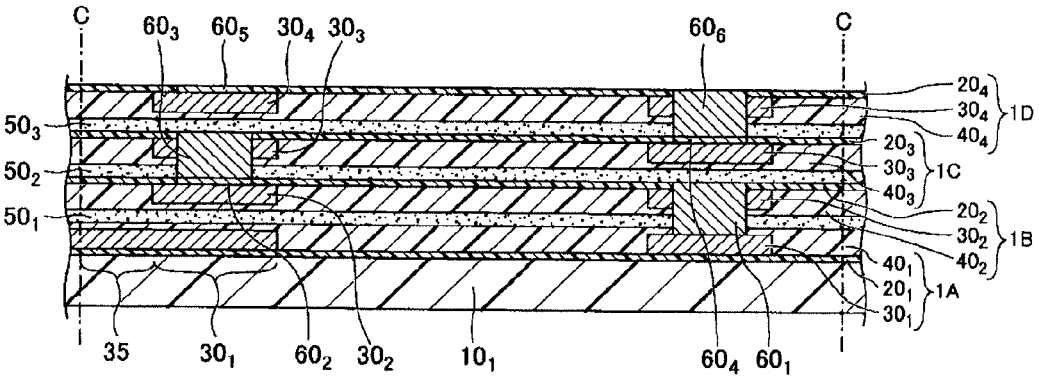

Next, in a process illustrated in FIG. 8B, similarly to the process illustrated in FIG. 5A, the fourth structural body 1D is manufactured, in which the fourth wiring $30_4$ serving as a fourth wiring (i.e., about a half turn) that is a part of the coil is formed. Then, similarly to the process illustrated in FIG. 6A to FIG. 7A, the fourth structural body 1D is stacked on the third structural body 1C. The via-wirings $60_5$ and $60_6$ are formed on the fourth wiring $30_4$. The fourth wiring $30_4$ and the via-wiring $60_5$ are electrically connected to each other. The via-wirings $60_4$ and $60_6$ are electrically connected to each other, and the third wiring $30_3$ and the fourth wiring $30_4$ are series-connected to each other via the via-wirings $60_4$ and $60_6$. The top surface of each of the via-wirings $60_5$ and $60_6$ can be set to be substantially flush with the top surface of the insulating layer $20_4$.

By this process, in a layered product in which the fourth structural body 1D is stacked on the third structural body 1C, the third wiring $30_3$, the via-wirings $60_4$ and $60_6$, and the fourth wiring $30_4$ are series-connected to form one turn of the coil. A layered product in which the fourth structural body 1D is stacked on the third structural body 1C is a unit-structural body. In the layered product in which the first structural body 1A to the fourth structural body 1D are stacked, two turns of the coil are formed by the first wiring $30_1$, the via-wiring $60_1$, the second wiring $30_2$, the via-wirings $60_2$ and $60_3$, the third wiring $30_3$, the via wirings $60_4$ and $60_6$, and the fourth wiring $30_4$.

Figure 9A:
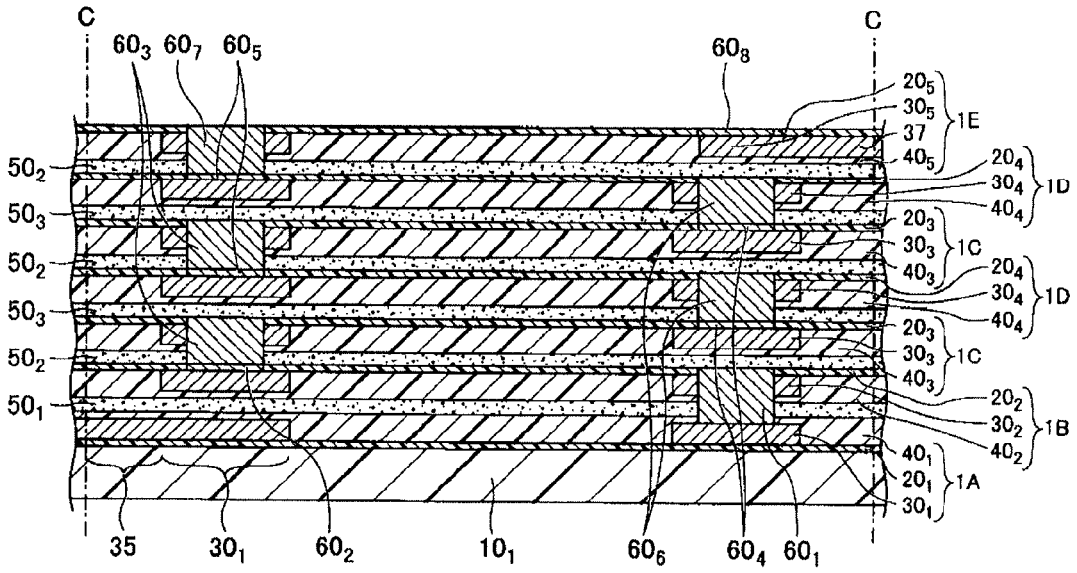

Next, in a process illustrated in FIG. 9A, unit-structural bodies of the necessary number are stacked. More specifically, the adhesion layer $50_2$, the third structural body 1C, the adhesion layer $50_3$ and the fourth structural body 1D of the necessary number, are stacked according to a necessary number of windings. In the embodiment, one unit-structural body which includes the third structural body 1C and the fourth structural body 1D as one set is added. Then, the fifth structural body 1E, in which the fifth wiring $30_5$ serving as an uppermost layer winding is formed, is stacked on the fourth structural body 1D. The fifth structural body 1E can be manufactured similarly to the third structural body 1C. However, the connecting portion 37 is formed at an end portion of the fifth wiring $30_5$ (see FIG. 1B). Thus, the structural bodies are stacked in order while the wirings of the adjacent structural bodies are connected to each other. Consequently, a spiral coil extending from the connecting portion 35 to the connecting portion 37 can be formed.

Figure 9B:
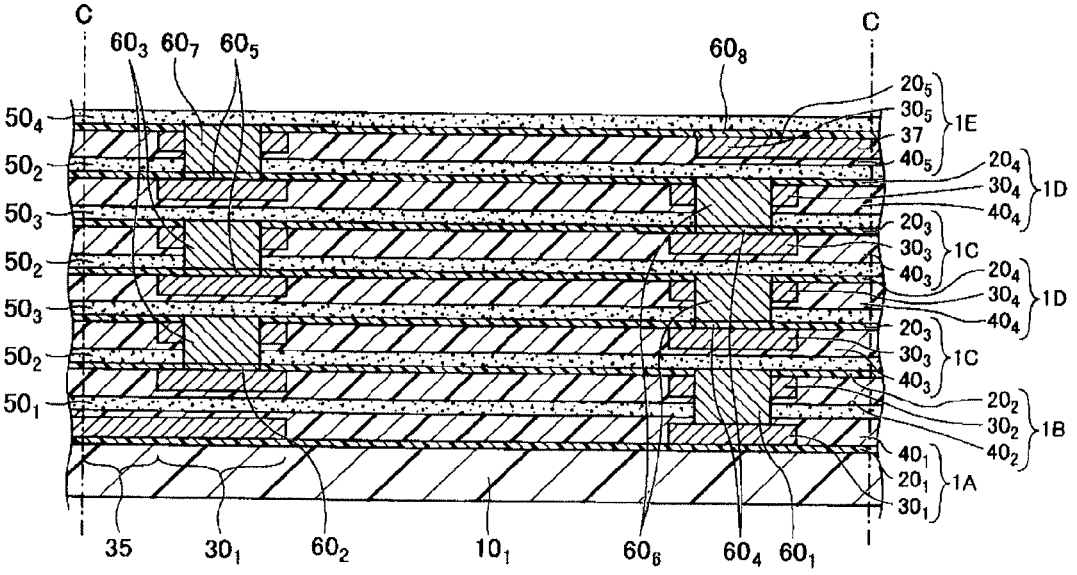

Next, in a process illustrated in FIG. 9B, the adhesion layer $50_4$ in which no opening portion is formed is stacked on the fifth structural body 1E. Next, in a process illustrated in FIG. 10A, the insulating layer $20_1$ is peeled from the substrate $10_1$. Next, in a process illustrated in FIG. 10B, a through-hole 1*x* penetrating each layer is formed by press working or the like in a region (at a substantially central portion of the structural body illustrated in FIG. 10B), in which no wiring (or coil) is formed.

Next, in a process illustrated in FIG. 11, a reel-like (or tape-like) structural body, in which coil substrates 1 are respectively formed in plural individual regions C, is individualized by cutting the structural body at the cutting position D illustrated in FIG. 3 into each sheet-like coil substrate 1M. In FIG. 11, fifty coil substrates 1 are formed on the coil substrate 1M. The coil substrate 1M may be shipped out as a product. Alternatively, each of the coil substrates 1 may be shipped out as products by further individualizing the coil substrate 1M into the individual coil substrates 1. Alternatively, the reel-like (or tape-like) structural body, on which the process illustrated in FIG. 10B is finished, may be shipped out as a product, without performing the process illustrated in FIG. 11.

In order to manufacture the inductor 100 (see FIG. 2), the coil substrate 1M illustrated in FIG. 11 is individualized by being cut into individual regions C, so that the coil substrate 1 illustrated in FIG. 1 is manufactured. Consequently, a side surface of the connecting portion 35 is exposed from the one side surface 1*y* of the coil substrate 1. A side surface of the connecting portion 37 is exposed from the other side surface 1*z* of the coil substrate 1.

Figure 12A:
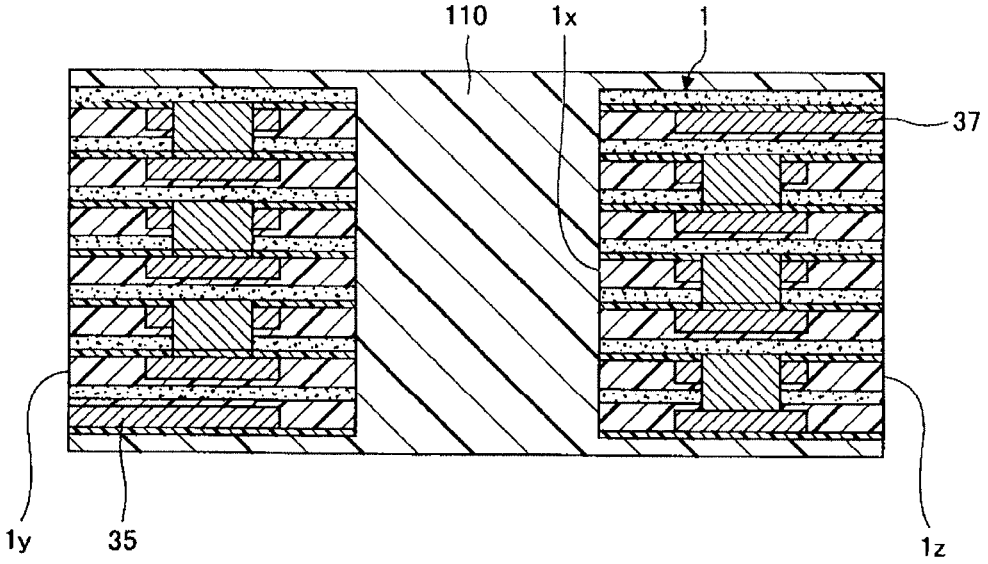
FIGS. 12A and 12B are views illustrating a process of manufacturing the inductor according to the embodiment.

Next, as illustrated in FIG. 12A, in order to seal the portions excepting the one side surface 1*y* and the other side surface 1*z* of each coil substrate 1, a sealing resin 110 is formed by, e.g., a transfer molding method or the like. For example, a molding resin containing fillers made of a magnetic material such as a ferrite or the like can be used as the sealing resin 110. The sealing resins 110 may be formed on the entire individual regions C in the state of the coil substrate 1M illustrated in FIG. 11, and then, the coil substrate 1M including the sealing resin 110 may be cut at each individual region C into a state illustrated in FIG. 12A.

Figure 12B:
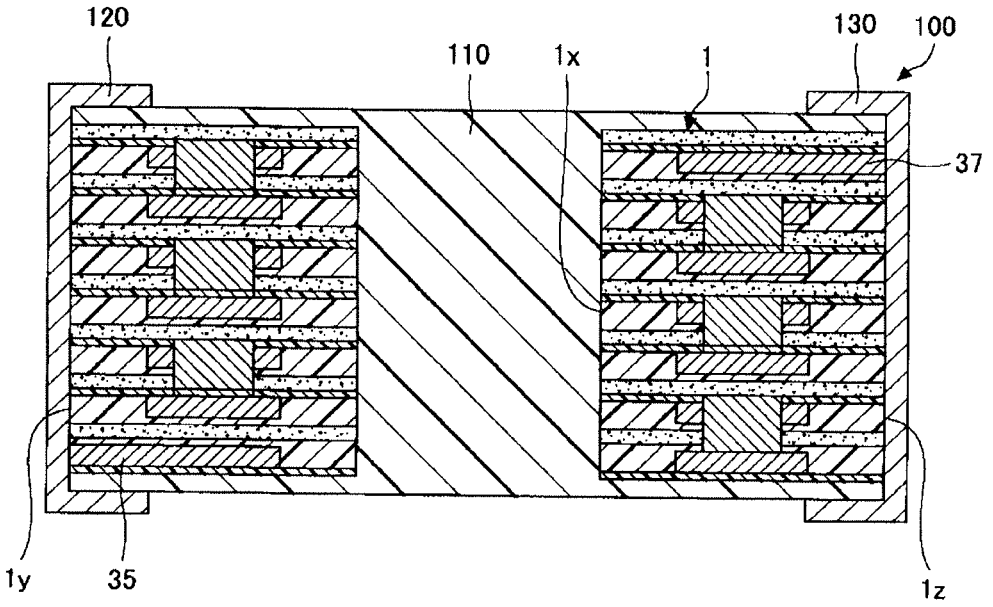

Next, as illustrated in FIG. 12B, the electrode 120 made of copper (Cu) or the like is continuously formed on one side surface and a part of each of the top surface and the bottom surface of the sealing resin 110 by a plating method or the application of paste. The inner wall surface of the electrode 120 has contact with the side surface of the connecting portion 35, which is exposed from one side surface 1*y* of the coil substrate 1. Thus, the electrode 120 and the connecting portion 35 are electrically connected to each other. Similarly, the electrode 130 made of copper (Cu) or the like is continuously formed on the other side surface and a part of the top surface and the bottom surface of the sealing resin 110. The inner wall surface of the electrode 130 has contact with the side surface of the connecting portion 37, which is exposed from one side surface 1*z* of the coil substrate 1 by a plating method or the application of paste. Thus, the electrode 130 and the connecting portion 37 are electrically connected to each other. Consequently, the inductor 100 is completed.

Thus, according to the coil substrate 1 according to the present embodiment, plural structural bodies, in each of which a wiring serving as a part of a spiral coil is covered with an insulating layer, are manufactured. Then, the plural structural bodies are stacked via adhesion layers. A single spiral coil is manufactured by series-connecting the wirings of the respective layers via the via-wirings. Consequently, a coil having an optional number of windings can be implemented without changing the planar shape of the coil substrate by increasing the number of stacked layers in the structural body. That is, the number of windings of the coil (i.e., the number of turns) can be increased at a size (about 1.6 mm×0.8 mm) smaller than the size of a related-art one.

A wiring corresponding to about a half turn of the coil is manufactured in one structural body (i.e., one layer). The remaining half turn of the coil is manufactured in another structural body (i.e., one layer). These structural bodies are stacked, and the wirings of these layers are series-connected via a via-wiring. Consequently, a wiring corresponding to one turn of the coil can be manufactured. That is, each unit-structural body in which a wiring corresponding to one turn of the coil is manufactured is produced by stacking two types of structural bodies including one structural body and another structural body. Then, unit-structural bodies of the necessary number are stacked. Thus, the number of turns of the coil can be increased infinitely. Consequently, inductance can be increased by a simple method.

Figure 13A:
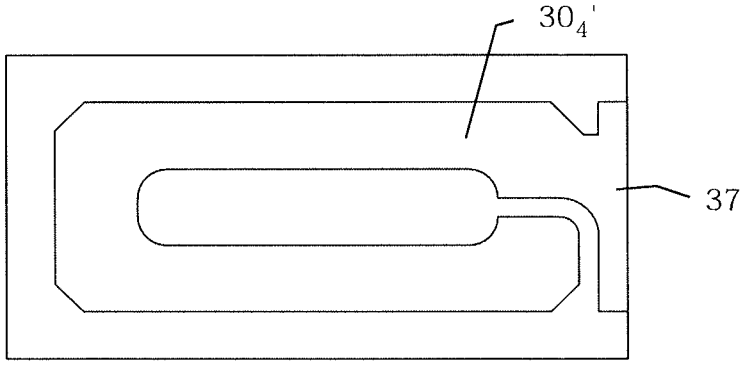
FIGS. 13A to 13D are views illustrating a modified example of wirings of the coil substrate according to the embodiment.
Figure 13B:
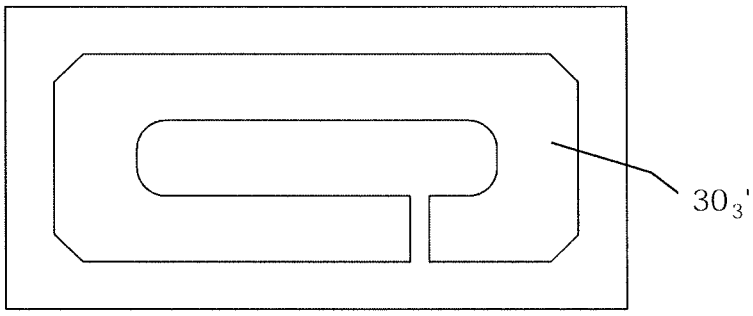
Figure 13C:
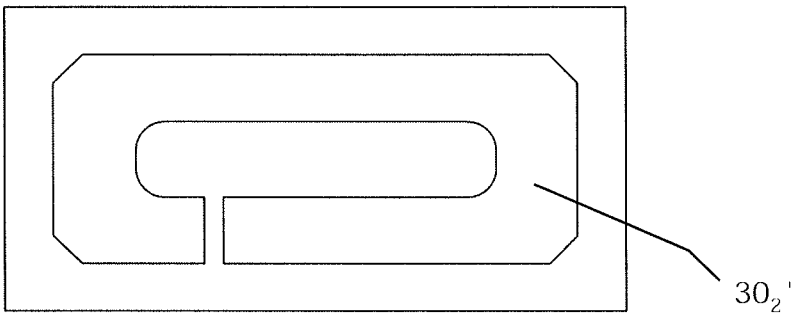
Figure 13D:
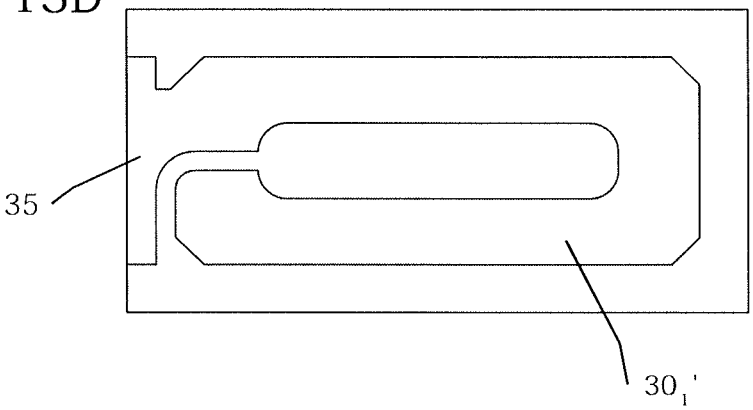

However, a wiring formed in one structural body is not limited to a wiring corresponding to a half turn of the coil. The wiring formed in one structural body may be set to correspond to (¾) turn of the coil. If a wiring formed in one structural body (i.e., one layer) is set to correspond to (¾) turn of the coil, it is necessary to prepare unit-structural bodies including four types of structural bodies. However, as compared with the case of manufacturing, in each single structural body (or layer), a wiring corresponding to a half turn of the coil, the number of stacked layers can be reduced when the same number of turns of the coil is implemented. Accordingly, the thickness of the coil substrate can be more reduced. For example, FIGS. 13A to 13D are views illustrating a modified example of wirings of the coil substrate according to the embodiment. In the modified example, 3.5 turns of the coil is formed by a first-layer wiring $\mathbf{30}_1$' (FIG. 13D), a second-layer wiring $\mathbf{30}_2$' (FIG. 13C), a third-layer wiring $\mathbf{30}_3$' (FIG. 13B) and a fourth-layer wiring $\mathbf{30}_4$' (FIG. 13A).

As described above, the number of turns of the coil, which corresponds to a wiring formed in one structural body (i.e., one layer), can be set to be equal to or less than 1. Thus, the width of a wiring formed in one structural body (i.e., one layer) can be increased. That is, the cross-section area in the width direction of a wiring can be increased. Consequently, a winding resistance directly linked to the performance of an inductor can be reduced.

Although a flexible insulating resin film (e.g., a polyphenylene-sulfide film) is used as the substrate 10*n* in the process of manufacturing the coil substrate 1, the resin film is finally peeled off, so that no film is left in a product. Consequently, the thickness of the coil substrate 1 can be reduced.

A coil substrate 1 can be manufactured on a coil substrate 10*n* using a reel-like (or tape-like) flexible insulating resin film as the substrate 10*n* by a reel-to-reel method. Consequently, the cost of the coil substrate 1 can be reduced by massive production.

Thus, the preferred embodiments of the invention have been described above in detail. However, the invention is not limited to the embodiments described above. Various modifications and alteration to the embodiments described above can be made within the scope of gist described in claims.

What is claimed is:

1. A coil substrate comprising:

a plurality of structural bodies, each of which comprises a first insulating layer, a wiring formed on the first insulating layer and configured to serve as a part of a spiral coil, and a second insulating layer formed on the first insulating layer and configured to cover the wiring, wherein the plurality of structural bodies are stacked such that a side of one structural body having the first insulating layer faces a side of an adjacent structural body having the second insulating layer, and wherein the spiral coil is formed by series-connecting the wirings of adjacent ones of the plurality of structural bodies.

2. The coil substrate according to claim 1, wherein the number of turns of the coil which corresponds to the wiring formed in each of the plurality of structural bodies is less than 1.

3. The coil substrate according to claim 1, wherein one structural body, which comprises the wiring corresponding to a half turn of the coil, and another structural body, which is adjacent to and stacked on the one structural body and comprises the wiring corresponding to a remaining half turn of the coil, form a unit structural body, and wherein the unit-structural body has a wiring corresponding to one turn of the coil formed by series-connecting the wiring corresponding to the half turn of the coil and the wiring corresponding to the remaining half turn of the coil via a via-wiring.

4. The coil substrate according to claim 3, wherein a plurality of the unit-structural bodies are stacked, and wherein the wirings of the adjacent ones of the unit-structural bodies are series connected to each other.

5. The coil substrate according to claim 1, wherein at least one of the structural bodies comprises a connecting portion provided at an end portion of the wiring and formed integrally with the wiring.

6. A coil substrate comprising:

a plurality of regions, in each of which a coil substrate according to claim 1 is formed.

7. The coil substrate according to claim 1, wherein the first insulating layer and the second insulating layer are made of an insulating resin.

8. The coil substrate according to claim 1, wherein a through-hole is formed in the coil substrate and the spiral coil is formed by the wiring provided around the through-hole.

9. The coil substrate according to claim 1, further comprising an opening passing through the first insulating layer, the wiring, and the second insulating layer, wherein adjacent wirings are connected by a via-wiring provided in the opening.

* * * * *